United States Patent [19]

Clayton

[11] Patent Number: 4,625,862

[45] Date of Patent: Dec. 2, 1986

[54] SUPPORT ASSEMBLY FOR GOLFING ACCESSORIES

[76] Inventor: Gene Clayton, 29 W. Walling, St. Louis, Mo. 63141

[21] Appl. No.: 725,938

[22] Filed: Apr. 22, 1985

[51] Int. Cl.[4] ..... A63B 55/00; A63B 57/00

[52] U.S. Cl. ..... 206/315.3; 150/52 G; 24/92; 224/901; 273/32 R

[58] Field of Search ..... 150/52 G; 206/315.2–315.4; 224/274, 901; 24/92, 306; 273/32 R, DIG. 30

[56] References Cited

U.S. PATENT DOCUMENTS

| | | | |
|---|---|---|---|
| 3,128,812 | 4/1964 | Scheurer | 206/315.4 |
| 3,374,508 | 3/1968 | Slimovitz | 224/901 X |
| 3,638,284 | 2/1972 | Baker | 150/52 G X |
| 3,847,110 | 11/1974 | Inoue | 273/32 R X |
| 3,895,797 | 7/1975 | Moore | 224/901 X |
| 3,985,364 | 10/1976 | Brady | 273/DIG. 30 X |
| 4,164,969 | 8/1979 | Dien | 206/315.4 |
| 4,257,607 | 3/1981 | Nedwick | 273/DIG. 30 X |
| 4,403,366 | 9/1983 | Lucke | 224/901 X |
| 4,498,615 | 2/1985 | Johnson | 224/274 |
| 4,520,855 | 6/1985 | Dien | 206/315.4 X |

FOREIGN PATENT DOCUMENTS

| | | | |
|---|---|---|---|
| 974912 | 11/1964 | United Kingdom | 150/52 G |

*Primary Examiner*—William Price
*Assistant Examiner*—Sue A. Weaver
*Attorney, Agent, or Firm*—Kalish & Gilster

[57] ABSTRACT

An accessory support assembly for use with golf bags, belts, garment loops and the like comprising a first component having a Velcro section, said component being suspended from said golf bag or other article, a second component carrying a Velcro section adapted for interengagement with the Velcro section on the first component, said second component being engaged to a frequently used accessory whereby the latter is maintained against loss during disuse by engagement of the Velcro sections on said first and second components.

2 Claims, 8 Drawing Figures

FIG. 1
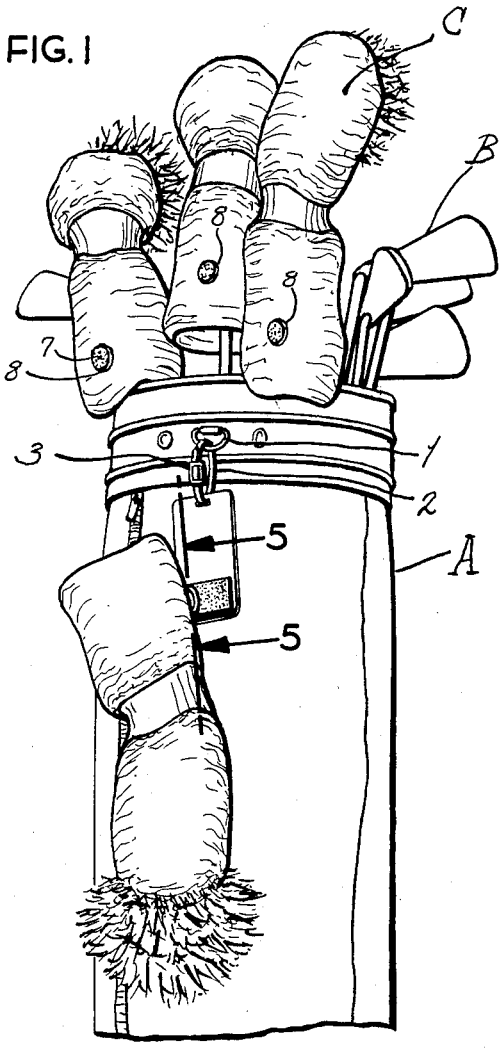
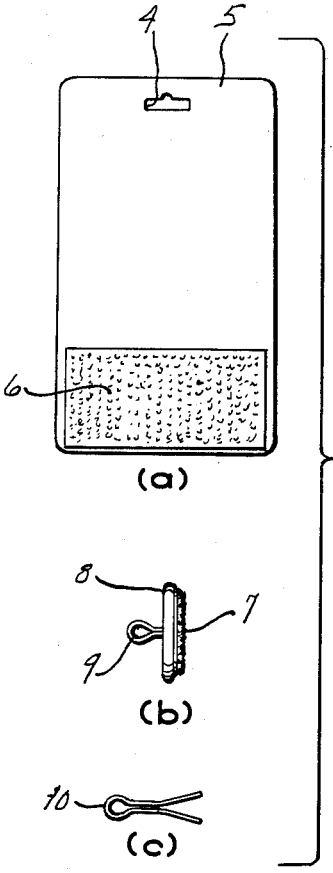
FIG. 2
FIG. 3
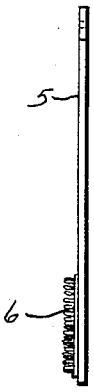
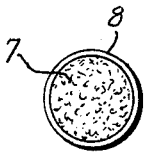
FIG. 4
FIG. 5
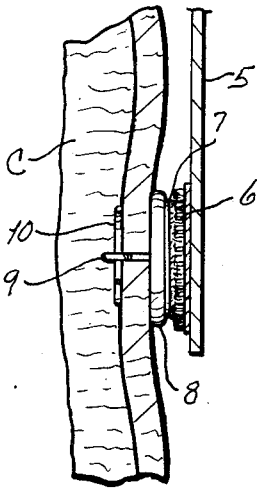
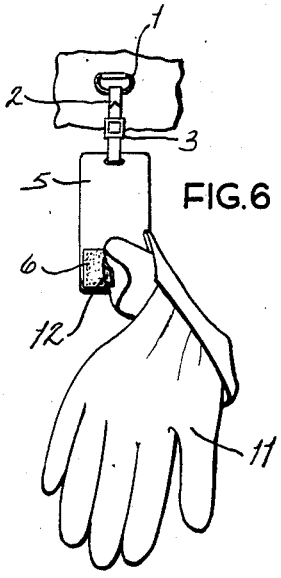
FIG. 6
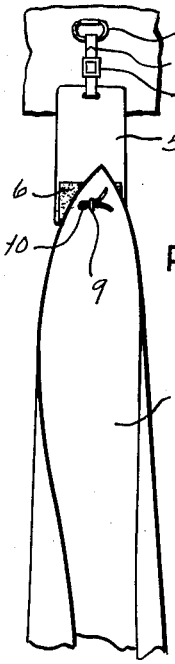
FIG. 7
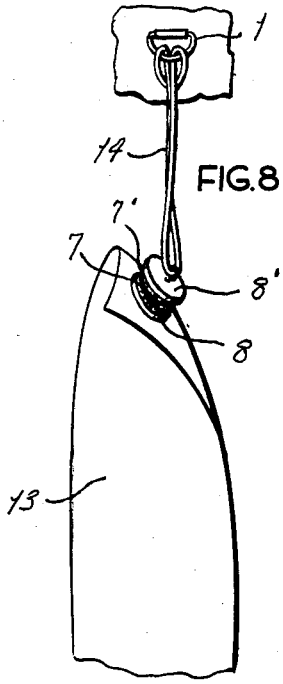
FIG. 8

SUPPORT ASSEMBLY FOR GOLFING ACCESSORIES

BACKGROUND AND SUMMARY OF THE INVENTION

This invention relates in general to golfing equipment and, more particularly, to a support, usable with golfing bags, for temporary disposition of golfing accessories.

In playing the game of golf, golfers utilize a wide variety of accessories, such as golf club head covers, golfer's gloves, towels, tee holders and like paraphernalia. With such extraneous items, it is quite probable that a golfer would misplace various of the same during the course of a round of golf since a golfer is customarily concentrating upon the character of a particular shot rather than the whereabouts of accessories, so that quite often such items are overlooked and hence lost.

Numerous efforts have been made heretofore for the purpose of preventing inadvertent displacement of accessories, such as with respect to head covers as shown in Scheurer U.S. Pat. No. 3,128,812 wherein an elaborate and lengthy strip of pile material is provided lengthwise or circumferentially of the bag for engagement with a cooperating element affixed upon a tab secured to the golf club head covers. In British Patent Specification No. 974,912 a similar structure is shown but wherein the strip of pile material comprehends component strips of male and female character for cooperating with like paired strips carried on the golf club head cover. Additionally, reference may be made to the Dien U.S. Pat. No. 4,164,969, which also reveals the provision of a circumferential band of pile material upon the golf bag for engaging cooperative material secured upon the golf club head covers which latter material may be configured as numerals or, simply, as patches. Thus the prior art has been directed fundamentally to means for supporting the particular head cover when the related golf club is in use so that the cover will not be lost during the interval of disuse. The Dien patent also shows the support pile material being disposed upon a snap ring engaged upon a strip-forming member mounted upon the golf bag.

To the present time there has been no demonstrable concern with respect to the numerous accessories, that is, other than head covers, which golfers constantly utilize and which being normally of unattached character are prone to be misplaced during a golf round. Furthermore, the art basically teaches the provision of permanently mounted pile material, known as Velcro, as on a golf bag either by lengthwise or circumferential strips and with the cooperative or mating element being similarly fixed on the head cover.

Accordingly, it is an object of the present invention to provide a support assembly for golfing accessories which comprehends mating members adapted for facile attachment to the related, respective articles, such as a golf bag, and a golf club head cover thereby obviating the necessity of causing such mating members to be permanently integrated with the associated articles.

It is another object of the present invention to provide a support assembly for golfing accessories of the type stated wherein the mating components may be easily and non-damagingly detachably engaged to the accessory and to the base article.

It is a further object of the present invention to provide a support assembly for golf accessories of the type stated wherein the mating components are of economical construction; which is of substantial durability yet being of markedly reduced size and weight; which assembly is attractive in appearance so as not to detract from the overall aesthetics of a golf bag and the supported accessories; and which is extremely useful so as to ensure against loss through customary oversight or negligence.

BRIEF DESCRIPTION OF THE DRAWINGS

FIG. 1 is a fragmentary perspective view of a golf bag provided with a support assembly for accessories constructed in accordance with and embodying the present invention.

FIG. 2, which is constituted of views (a), (b), and (c) ilustrates the three basic components of the support assembly illustrated in FIG. 1.

FIG. 3 is a side view of the support assembly component illustrated in FIG. 2(*a*).

FIG. 4 is a front view of the component illustrated in FIG. 2(*b*).

FIG. 5 is a vertical transverse sectional view taken along 5—5 of FIG. 1.

FIG. 6 is a fragmentary view illustrating the retention of a golfer's glove by means of the present invention.

FIG. 7 is a fragmentary view illustrating a golfer's towel or the like as suspended by the support assembly of the present invention.

FIG. 8 is a fragmentary perspective view illustrating another form of the support assembly of the present invention.

DESCRIPTION OF THE PRACTICAL EMBODIMENTS

Reference will now be made to the drawings which illustrate practical embodiments of the present invention. It must be noted that although this invention has extreme utilitarian value with respect to usage in conjunction with golf bags for temporary retention of golfing accessories, the same is not to be deemed as only useful therewith. It should be recognized that this invention is useful with other articles, devices or the like which provide suitable and convenient means for cooperation with the support assembly such as articles of personal wear including belts, loop-forming members as stitched on clothing, and the like.

Turning now to FIG. 1, A generally designates a conventional golf bag for receiving the customary collection of golf clubs B, certain of which are provided with the usual head covers C. Secured upon bag A in suitable fashion is a ring 1 through which is passed a strap 2. Strap 2 incorporates a buckle 3 or other closure and extends through a compatible opening 4 formed at the upper end of a tag 5. Said tag 5 may be of any suitable configuration but is shown herein as being of generally rectangular plate-like form and being relatively thin. It is fabricated preferably of plastic but may be of metal, if desired, and is of sufficient thickness to be extremely durable and resistant to damage through extensive usage. Said tag 5 on one face thereof, and in the lower end portion thereof, is provided with a section 6 of pile material, such as Velcro, and may be either of the loop or hook type. With reference to FIGS. 1 and 2 it will be seen that the portion of tag 5 above the Velcro section 6 is available for inscription thereon in any appropriate manner of a preselected text such as advertising matter and the like or the same may carry the user's name and other information. Thus with respect to FIG. 1 it will be seen that tag 5 is adapted to normally pend from the golf bag ring 1, with Velcro section 6 being thus presented outwardly for ready availability.

Provided for cooperating, or mating relationship, with section 6 is a section 7 of Velcro which will be of hook or loop character dependent upon the nature of section 6 so as to assure of appropriate interengagement between the same. Section 7 is provided upon one face of a button-like member 8 as formed of metal, plastic or the like which serves as a backing for section 7 and carries an eyelet 9 projecting from the rearward face thereof. The fabric of construction of head cover C is of relatively loose or open weave so that eyelet 9 may project through the same without causing damage. A cotter pin 10 is then passed through eyelet 9 to secured member 8 in position upon cover C with Velcro section 7 thus being presented outwardly.

Accordingly, when a golfer wishes to utilize a golf club, the head of which is normally cased in a cover C; the latter is necessarily removed and then the individual applies section 7 thereof against section 6 of tag 5 so as to suspend securely the withdrawn cover while the particular club is in use. By this cooperative relationship between Velcro sections 6 and 7, the golf club head cover is reliably retained until returned to encasing disposition upon the associated club. By these means the loss of the cover is inhibited such as might very well occur if the user had to place the cover in some location while using the club.

It will be seen that neither of the components for effecting the support of the cover are permanently secured to the associated articles. Member 8 may be easily removed by simple withdrawal of the cotter pin 10 and the tag 5 can be withdrawn by the mere expedient of opening strap 3. Therefore, there is no necessity of costly fixed application of Velcro sections, bands, or the like to the golf bag or any other like supportive article nor the need to secure, as by stitching, a Velcro section to the head covers or like accessory. In addition, tags 5 have extreme versatility by reason of concurrently serving for identification of the user or for provision of textual matter and with the same being easily interchangable.

With reference to FIG. 6 it will be observed that tag 5 with its Velcro section 6 may be utilized with a cooperative Velcro section as provided upon other elements. Exemplary is a golfer's glove 11 which carries a closure tab 12 having a customary Velcro section (not shown) on the normally inner surface thereof for adherence to a cooperative patch (not shown) on the wrist portion of the glove. There are numerous articles having Velcro closures that would manifestly be quite suitable for suspension from tag 5. It will be further recognized that tags 5 may be supported by the associated straps 3 from any convenient point such as a belt, garment loops, etc.

Referring now to FIG. 7, it will be seen that member 8, together with the coordinating cotter pin 10 is useful with fabric articles other than golf club covers such as a towel 13 or the like constructed to permit the harmless penetration of eyelet 9 so that the same is thus readily adapted for suspension from tag 5. In this application the present invention in addition to being useful for golfers would also be readily useful for football playing field officials who have need of a towel to wipe off a football periodically during games in inclement weather; or for the yellow flags for penalty indication; or for mechanics and service station attendants who use rags for wiping off oil dipsticks as well as for the hands, etc. Accordingly, the foregoing merely demonstrates the extreme versatility and widespread applicability of the present invention.

Referring to FIG. 8, a modified support assembly is shown which comprises a pair of members 8, 8' wherein the latter, in effect, replaces the tag 5. Members 8, 8' are of identical construction except that the related Velcro section 7, 7' respectively are of appropriate interengaging character, that is, one of hooks, and the other of loops. Member 8' is suspended by a suitable flexible elongated member 14 fabricated of any appropriate material such as plastic and the like, which is of loop formation for suspension from ring 1. Member 8' together with the sustaining element 14 may be used in lieu of tag 5 so that in certain situations it might appear more aesthetic and will function equally reliably.

The foregoing thus shows beyond peradventure a marked advance in the field of providing temporary support for items which have frequent usage but are subject to exasperating displacement during periods of non-use. As shown hereinabove, the novel support assembly has marked usefulness in the golfing field, providing golfers with a reliable means for retaining various accessories in physical attachment to the golf bag, or the golfer's belt, rather than to be placed at some point independent of the golf bag with the danger of failing, through oversight, to retrieve same. Furthermore, as developed herein, the present invention is useful other than with golf bags so that the scope of useful application is most substantial.

What is claimed is:

1. The combination with a golf bag having a loop-forming member provided on the exterior thereof and golf club head covers provided for selected clubs retained within said bag, of a temporary support assembly for said head covers comprising a first component of flat, plate-like character having opposite inner and outer faces, a first section of pile material being fixed on the outer face of said first component, an opening provided in said component, means passing through said opening and said bag loop-forming member for suspending said first component, a second component having a relatively rigid backing portion, a second section of pile material provided on one side of said backing portion, and an eyelet extending from the opposite side of said backing portion, said eyelet projecting through the related golf club cover, and retention means presented inwardly of said cover for acceptance within the eyelet for securing said second component on said cover, said first and second pile sections being designed for mutual engagement whereby during disuse said golf club cover may be retained against displacement upon said first component.

2. The combination defined in claim 1 wherein said means suspending said first component comprises a flexible strap, and means for optionally securing said strap in closed condition.

* * * * *